US005940987A

United States Patent [19]

Stummer

[11] Patent Number: 5,940,987

[45] **Date of Patent: *Aug. 24, 1999**

[54] HEAT EXCHANGER WITH CONCENTRIC TUBES

[75] Inventor: Giselher Stummer, Kumbeg, Austria

[73] Assignee: Andritz-Patentverwaltungs-Gesellschaft M.B.H., Graz, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 08/843,303

[22] Filed: Apr. 14, 1997

[30] Foreign Application Priority Data

Apr. 17, 1996 [AT] Austria ..... 693/96

[51] Int. Cl.[6] ..... F26B 17/00

[52] U.S. Cl. ..... 34/576; 34/578; 165/104.16

[58] Field of Search ..... 34/576, 578; 165/104.14, 165/104.16, 142, 145

[56] References Cited

U.S. PATENT DOCUMENTS

| | | | |
|---|---|---|---|
| 3,833,051 | 9/1974 | Frank | 165/1 |
| 3,982,901 | 9/1976 | Steever et al. | 34/578 X |
| 4,072,189 | 2/1978 | Chaix et al. | 165/142 |
| 4,290,387 | 9/1981 | De Feo et al. | 165/142 X |
| 4,431,049 | 2/1984 | Zamma et al. | 165/142 |
| 4,452,233 | 6/1984 | Goodman, Jr. et al. | 165/142 X |
| 4,699,210 | 10/1987 | Brännström | 34/576 X |
| 5,251,691 | 10/1993 | Collin et al. | 165/104.16 |

*Primary Examiner*—Henry Bennett
*Assistant Examiner*—Steve Gravini
*Attorney, Agent, or Firm*—Roylance, Abrams, Berdo & Goodman, L.L.P.

[57] ABSTRACT

A heat exchanger particularly for use in fluidized-bed driers, includes at least one supply pipe and one discharge pipe for the heat transfer fluid, and at least one heat exchange tube carrying the heat transfer fluid. In order to make the heat exchanger tubes easily accessible and to ensure that the distribution and drainage system for the heat transfer fluid affects the flow through the heat exchanger as little as possible, each heat exchanger tube is connected to the supply pipe for heat transfer fluid at one end and is closed at the other end. Each heat exchange tube includes an inner outlet tube pipe with a smaller diameter, which has at least one opening at the closed end of the heat exchanger pipe and an opposite end connected to a drainage discharge pipe for receiving the heat transfer liquid.

13 Claims, 3 Drawing Sheets

HEAT EXCHANGER WITH CONCENTRIC TUBES

FIELD OF THE INVENTION

The present invention relates to a heat exchanger, particularly for use in a fluidized-bed drier. More particularly, the invention is directed to a heat exchanger with at least one supply pipe and at least one drainage pipe for the heat transfer fluid, at least one heat exchanger pipe carrying the heat transfer fluid and an outlet pipe concentric with the heat exchanger pipe.

BACKGROUND OF THE INVENTION

Conventional heat exchangers are fitted with several supply pipes carrying a heat transfer fluid for feeding a distribution system with heated heat exchanger fluid, such as, for example, hot water or steam. While this heated fluid passes through the heat exchanger pipes, some of the heat transfers to the medium flowing around the heat exchanger. When the heat exchange fluid has cooled down, which can be in condensed form if steam is used, it is drained off through a collecting system having a drainage pipe at the other end of the heat exchanger pipes.

The distribution system for the heat transfer fluid is usually positioned at one end of the heat exchanger pipes. The location of the distribution system makes the heat exchanger pipes not easily accessible, such as, for example, for cleaning or repair. Furthermore, the transverse distribution pipes reduce the free passage cross-section area and obstruct the flow of material through the heat exchanger. The obstruction of flow around the heat exchanger is particularly pronounced when the material to be dried flows perpendicularly onto the distribution level. If this type of heat exchanger is used in fluidized-bed drying plants, at least the top section of the heat exchanger is located in the fluidized bed, to which the heat from the heat transfer fluid is to be conveyed. The distribution system here seriously obstructs the flow of the medium that fluidizes the fluidized bed, thus obstructing the flow of the fluidized bed itself. Since there are distribution pipes in the fluidized bed, there is a danger of the material being dried building up on the heat exchanger, which is aggravated by the narrowing of the flow passage cross-section areas.

Accordingly, there is a continuing need in the industry for a heat exchanger that does not restrict the flow in a fluidized bed.

SUMMARY OF THE INVENTION

A primary object of the present invention is to provide a heat exchanger with easily accessible heat exchanger pipes for inspection, maintenance and repair.

A further object of the invention is to provide a heat exchanger having a distribution and drainage system for the heat transfer fluid with minimal affects of the flow of fluid or material around the heat exchanger possible, particularly when the flow of fluid or material around the heat exchanger is in a cross direction to the longitudinal direction of the supply or drainage system. The heat exchanger of the invention is particularly suitable for use in the fluidized-bed driers by minimizing the obstruction of the flow of the fluidizing medium around the heat exchanger and preventing the build-up of the material being dried in the fluidized drier.

A further aim of the invention is to provide a fluidized-bed drier which is easy to maintain and repair, and where the fluidized-bed flow is largely unobstructed by the heat exchanger.

Another object of the invention is to provide a heat exchanger for use in a fluidized bed drier where the heat exchanger pipe has a discharge tube mounted concentrically within the heat exchanger tube.

The heat exchanger according to one aspect of the invention includes at least one outer heat exchanger pipe having one end connected to the supply pipe for receiving the heat transfer fluid and the other end of the heat exchange pipe being closed off. Each exchanger pipe contains at least one inner discharge pipe having a smaller diameter than the heat exchanger pipe, where the inner pipe has at least one opening adjacent the closed end of the outer heat exchanger pipe. The opposite end of the inner pipe is coupled to a drainage pipe. Thus, each heat exchanger pipe is accessible at one end for inspection, maintenance and repair, and also for easier replacement if necessary. Since distribution systems for the heat transfer fluid are omitted at one end of the heat exchanger pipes, the flow through the heat exchanger is less obstructed than in conventional heat exchanger designs. When the heat exchanger according to the invention is used in a fluidized-bed drier, the risk of a material build-up is largely avoided due to the free flow passage around the unattached and unobstructed, free ends of the heat exchanger pipes.

When hot steam is used as a heat transfer fluid, the inner fluid discharge pipe and the drainage pipe sections can be kept to very small dimensions because they only carry blow-through steam and air. A substantial portion of the condensed steam is drained off through the steam supply pipe. The supply conduit for heat transfer fluid also provides drainage of the condensate when the heat transfer fluid is hot steam. The supply pipe is limited to a supply function only when non-condensing fluids are used.

Another object of the invention is to provide a heat exchanger having a second fluid outlet pipe within the outer heat exchanger pipe and having its open end located approximately at the closed end of the outer heat exchanger pipe. The face of the opening in the inner pipe is preferably positioned on a slant or incline with respect to the longitudinal axis of the inner discharge pipe. This ensures the flow of the heat transfer fluid through the entire length of the heat exchanger pipe. The end of the slant of the inlet opening of the inner discharge pipe is able to contact the closed end of the outer pipe to provide a support for stabilizing the end of the inner pipe at the end of the heat exchanger pipe. The slanted opening also ensures a favorable flow pattern in the pipe where the heat transfer fluid which has cooled down after heat exchanging flows to its drainage point. According to a further feature of the invention, the inner, discharge pipe extends transversely through the supply pipe for the heat transfer fluid and leads into a drainage pipe for air and/or steam. Preferably, several adjacent heat exchanger pipes are placed along a preferably straight supply pipe for receiving the heat transfer fluid. The drainage pipe is preferably parallel to and adjacent the supply pipe for the heat transfer fluid. This provides a relatively simple and stable design, and reduces the area of the distribution system to improve flow through the heat exchanger.

A further feature of the invention provides for at least two supply pipes for heat transfer fluid, and a corresponding number of parallel drainage pipes leading into a common collecting pipe, where each supply pipe has several adjacent heat exchanger pipes extending in a perpendicular direction with respect to the longitudinal dimension of the supply pipe. This simplifies the design and reduces the area of the heat transfer fluid system.

For optimum use in a fluidized-bed drier, the heat exchange pipe is mounted in an essentially vertical position with respect to the direction of flow of the fluidized bed. The supply and drainage pipes are located at the lower end of the heat exchange pipe and extend transversely into the fluidized bed. In this way, the heat exchanger with the top end of the heat exchange pipes are free of supply and drainage pipes, and can be installed in the fluidized bed without reducing the flow passage area or the fluidizing flow being obstructed by the heat exchanger. This further reduces the risk of material being dried from building up on the heat exchanger.

A further object of the invention is achieved using a fluidized-bed drier with a large vertical drier housing containing at least one heat exchanger according to the present invention.

The objects of the invention are basically attained by providing a heat exchanger comprising: at least one supply conduit for supplying a heat exchange fluid; at least one heat exchange tube having a first end connected to the supply conduit for receiving a heat exchange fluid from the supply conduit and a closed second end spaced from the first end; and a fluid outlet tube disposed within the at least one heat exchange tube for receiving the heat exchange fluid from the heat exchange tube, the outlet tube having a first end coupled to a discharge conduit and a second open end at the closed end of the heat exchange tube.

The objects of the invention are further attained by providing a fluidized bed drier comprising: a drier housing having at least one outer side wall, the wall having a fluid inlet at a lower end for receiving a fluidizing fluid and a fluid outlet at an upper end for discharging said fluidizing fluid; at least one supply conduit disposed in the drier for supplying a heat exchange fluid; a plurality of heat exchange tubes extending substantially perpendicular to the at least one supply conduit and having a first end connected to the supply conduit for receiving the heat exchange fluid and a closed second end; an outlet tube disposed within each of the heat exchange tubes for discharging heat exchange fluid from the heat exchange tubes, each the outlet tubes having a first end coupled to a discharge conduit and a second open end disposed at the closed end of the heat exchange tube.

These and other aspects and salient features of the invention will become apparent from the following detailed description, which, taken in conjunction with the annexed drawings, form part of this original disclosure.

DETAILED DESCRIPTION OF THE INVENTION

The present invention is directed to a heat exchanger and to a fluidized bed drying apparatus containing the heat exchanger. The invention is particularly directed to a heat exchanger having an outer tube and a concentric inner tube forming an outlet for the heat exchange fluid.

Figure 1:
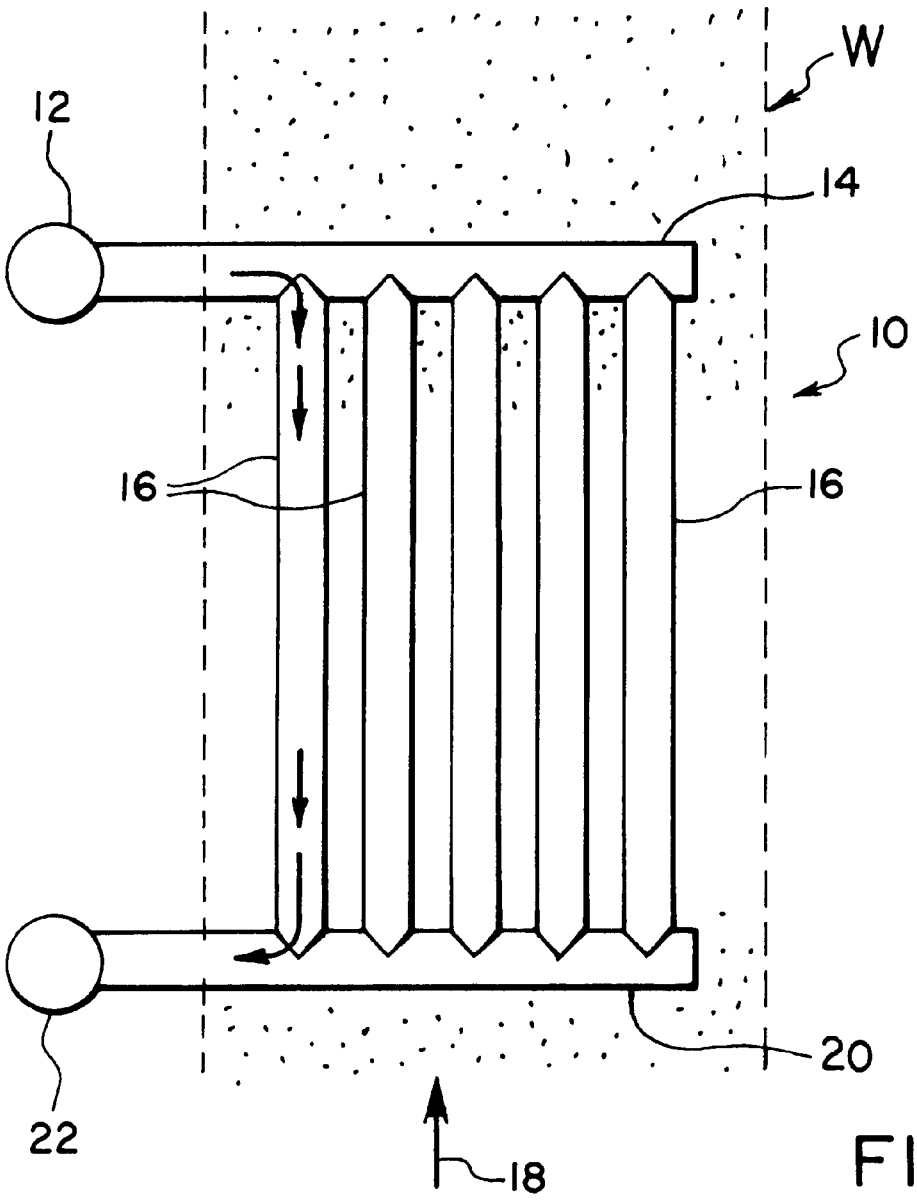
FIG. 1 is a side elevational view of a conventional heat exchanger.

In a conventional prior art fluidized bed drier including heat exchanger 10 shown in FIG. 1, a supply pipe 12 is provided to supply hot steam as the heat transfer fluid. Several straight distribution pipes 14 extend laterally from the supply pipe 12 to carry the hot steam into essentially vertical heat exchanger pipes 16. The heat exchanger 10 is located in the fluidized bed W with the supply pipe 12 positioned at the upper end of the fluidized bed so that the hot heat transfer fluid passes through the supply pipe 12 and downwardly through the heat exchange pipes 16 countercurrent to the direction of flow of the bed W. The fluidized bed formed from material to be dried which is fluidized by means of an air stream flowing from the bottom upwards in the direction of arrow 18. After the heat transfer fluid has transferred its thermal energy to the material in the fluidized bed W and has been substantially condensed in the process, the heat transfer liquid emerges in the form of a condensate from the adjacent heat exchange pipes 16 into the drainage pipes 20 at the bottom of the bed. Several drainage pipes 20 flow into a common collecting drainage pipe 22 located in the lower sector of the heat exchanger 10.

Figure 2:
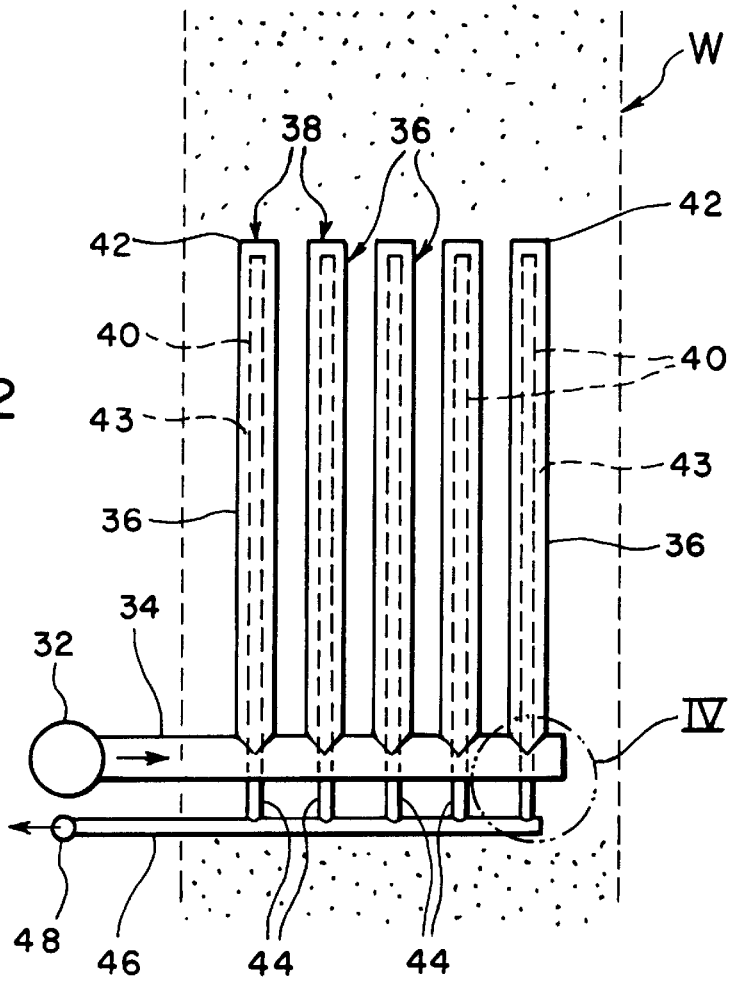
FIG. 2 is a side elevational view of a heat exchanger according to a first embodiment of the invention.

The heat exchanger 30 according to one embodiment of the invention illustrated in FIG. 2 includes a primary supply conduit or pipe 32 to supply the heated heat transfer fluid. The hot fluid can be steam, super-heated steam, air, or exhaust combustion gases. As shown in FIG. 2, in the supply pipe 32 for the transfer liquid is located in the heat exchanger's lower part. A plurality of substantially horizontal distribution supply pipes 34 are coupled to the supply pipe 32 and extend substantially perpendicular from the side thereof for carrying the heat transfer fluid. A plurality of vertical heat exchange pipes or tubes 36 are coupled to and extend substantially perpendicular from the distribution pipes 34. As shown, the heat exchange pipes 36 extend upwardly substantially in the upward direction of travel of the fluidized bed. The heat exchange pipes 36 terminate at a free, unattached top end 38. The free ends 38 of heat exchange pipes 36 are preferably closed by a flat panel 42 or other closure. The free ends of heat exchange pipes are arranged to extend longitudinally in the direction of movement of the fluidized bed W when the heat exchanger is used in a fluidized-bed drier. The longitudinal orientation of the heat exchange tubes 36 minimizes turbulence or obstruction of flow of the fluidized bed.

Inside each of the outer heat exchange pipes 36, is a second, concentric discharge conduit or pipe 40 with a smaller outer diameter than the heat exchange pipe 36. The inner, discharge pipe 40 is dimensioned to allow the heat transfer fluid to flow between the pipes 36, 40 and downwardly through inner pipe 40. The heat transfer fluid in the heat exchange pipe 36 passes upwards to transfer its thermal energy through the wall of the heat exchange pipe 36 to the material to be dried in the fluidized bed W. The steam or other vapor in the heat exchange tubes 36 can condense in the space 43 between the inner outlet pipe 40 and the inside of the heat exchanger pipe 36. The condensate is returned to the distribution supply pipe 34 and flows to the primary supply pipe 32. Thus, the supply pipe 34 and the primary supply pipe 32 act as condensate drainage pipes.

The heat transfer fluid, such as steam and/or air, enters the inner discharge pipe 40 through a hole 50 and is conveyed downwards. At the bottom end of the heat exchanger pipe 36, the second, inner discharge pipe 40 extends transversely through the distribution supply pipe 34. In the embodiment illustrated, the discharge pipe 34 has a single hole 50 to allow the fluid to enter. In further embodiments, more than one hole can be provided. The discharge pipe 40 includes an extension 44 extending beyond the supply pipe 34.

In preferred embodiments, the inner discharge pipes 40 in the heat exchanger pipes 36 are attached to a distribution supply pipe 34 and are also connected to a common drainage pipe 46 at the bottom. In preferred embodiments, the drainage pipe 46 extends beneath, and also parallel to the distribution supply pipe 34 into a primary collecting drainage pipe 48 for the heat transfer fluid. This primary collecting drainage pipe 48 preferably extends underneath the primary supply pipe 32 and preferably parallel thereto.

When the heat transfer fluids used are non-condensing fluid such as hot air or combustion gases, the heat transfer fluid enters the inner discharge pipe 40 through the hole 50 after passing along the length of the heat exchange pipes 36 and then flows down to the lower end of the inner discharge pipe 40. The heat exchange fluid passes through the extension 44 into the drainage pipe 46 and finally into the primary collecting drainage pipe 48.

Figure 3:
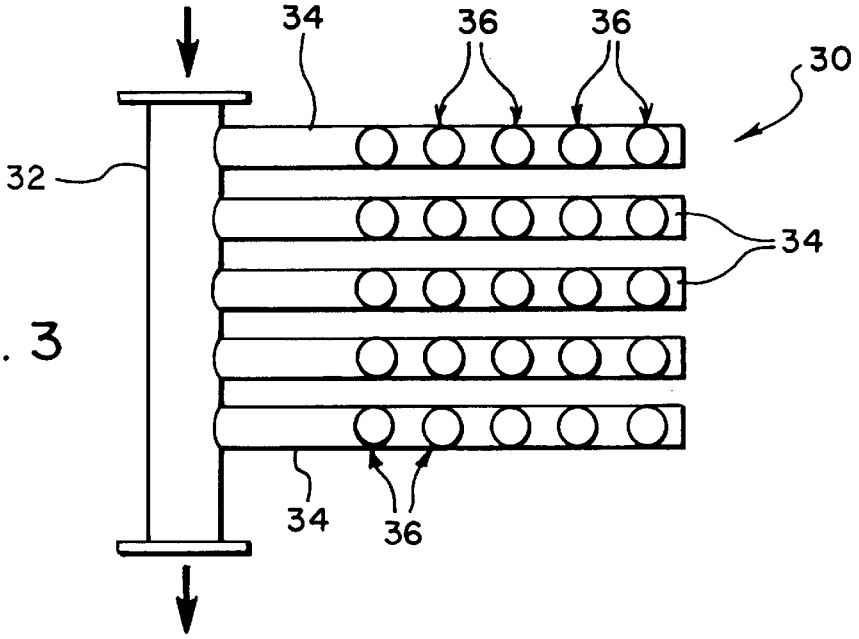
FIG. 3 is a top view of a horizontal projection of the heat exchanger shown in FIG. 2.

As shown in the top view of FIG. 3, there are preferably several, essentially straight, horizontal and parallel distribution pipes 34 connected to one supply pipe 32 and to one collecting drainage pipe below the supply pipe 32 (not shown in FIG. 3). Each of these distribution supply pipes 34 supports several vertical heat exchanger pipes 36, the top ends of which protrude upwardly into the fluidized bed W.

Figure 4:
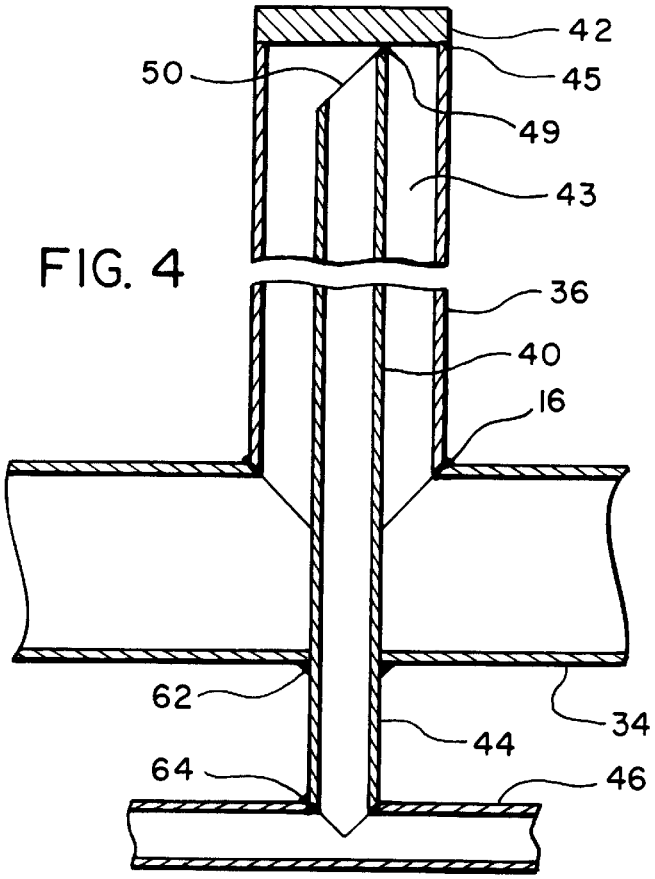
FIG. 4 shows an enlarged cross-sectional side view of a heat exchanger pipe in a preferred embodiment of the invention.

A single heat exchanger pipe 36 according to a preferred embodiment of the invention is shown on a larger scale in cross-section in FIG. 4. The pipe 36 is connected vertically to the distribution supply pipe 34 by welding at 60 with a very simple weld as shown or secured with a detachable joint. As shown, the heat exchange pipe 36 has a substantially cylindrical shape having a longitudinal axis and an annular shaped side wall. The top end of the heat exchanger is closed with the plain end plate 42 or other closure, which usually is also welded at 45 with a very simple weld. The inlet hole 50 for hot heat transfer fluid, such as air or steam is slanted in the axial direction with respect to the longitudinal axis of the heat exchange pipe 36. The inlet hold 50 as shown faces radially outward toward the side wall of the heat exchange tube 36. In alternative embodiments, the hole 50 can be cut transverse to the axis of the discharge pipe 40 and spaced a short distance from the end cap 42. In still further embodiments, one or more holes can extend transversely through the side wall of the heat exchange pipe.

The tip 49 of the inner pipe 40 in one embodiment contacts the inside of the end plate 42 to stabilize the position of the inner pipe 40 within the heat exchanger pipe 36. The tip 49 can frictionally engage the end plate 42 or be fixed thereto by some other means.

If a non-condensing heat transfer liquid is used, such as, for example, hot water, the drainage outlet pipes 46, 48 must, of course, be sufficiently larger to carry the liquid. On the other hand, the distribution pipe 34, which now is no longer required to return the condensate, can be smaller. The lower end of the inner, discharge pipe 40 extends through an opening 62 in the distribution supply pipe 34 with the extension 44 continuing a little further down beyond the bottom end of supply pipe 34 and is connected to the drainage pipe 46 for air and/or blow-through steam or cooled heat transfer fluid. In the embodiment shown, extension 44 of pipe 40 is welded at 64 to drainage pipe 46. Drainage pipe 46 is preferably parallel to and adjacent the pipe 34.

Figure 5:
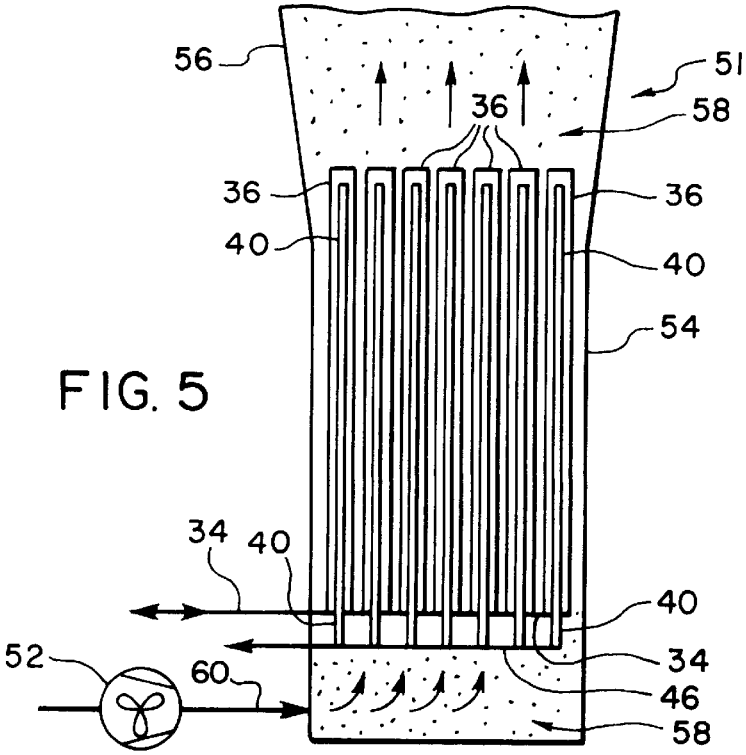
FIG. 5 contains a schematic side view of a fluidized-bed drier according to the invention.

FIG. 5 shows a schematic example of a fluidized-bed drier 51 with the heat exchanger 30 according to the invention for drying the material fluidized in the fluidized bed 58. The air required for fluidizing is blown by a supply air fan 52 through an air feed conduit 60 into the tower-shaped drier housing 54, which preferably widens towards the top end 56. The fluidized bed 58 passes over the heat exchanger 30 with the vertically oriented heat exchanger pipes 36 with hot heat transfer fluid passing therethrough fed through the supply pipe 34 and from which condensate drains off. Steam and air are then drained off through the discharge pipe 40 and drainage pipes 46 to the drainage pipe 48.

In the embodiment of FIG. 5, the supply pipes 34 and the discharge pipes 46 and 48 are substantially parallel and closely spaced together in the lower portion of the fluidized bed. In addition, the supply pipe 34 and discharge pipes 46 and 48 are positioned one above the other with the heat exchange tubes 36 oriented vertically with respect to the direction of movement of the fluidized bed 58. This arrangement reduces the turbulence and interference of flow of the fluidized bed 58 as the fluidized bed flows along the length of the heat exchange tubes 36.

While various embodiments of the invention have been selected to illustrate the invention, it will be understood by one skilled in the art that various modifications and additions can be made without departing from the invention as described in the following claims.

What is claimed is:

1. A heat exchanger comprising:

at least one supply conduit for supplying a heat exchange fluid;

at least one heat exchange tube having a first end connected to said supply conduit for receiving a heat exchange fluid from said supply conduit and a closed second end spaced from said first end; and a fluid outlet tube for receiving the heat exchange fluid from said heat exchange tube and being disposed within said at least one heat exchange tube, said outlet tube having a first end extending completely through said supply conduit in a transverse direction and being coupled to a discharge conduit said outlet tube further having a second open end at said closed end of said heat exchange tube, wherein said supply conduit is substantially parallel to and spaced from said discharge conduit.

2. A heat exchanger comprising:

at least one supply conduit for supplying a heat exchange fluid;

at least one heat exchange tube having a first end connected to said supply conduit for receiving a heat exchange fluid from said supply conduit and a closed second end spaced from said first end; and a fluid outlet tube disposed within said at least one heat exchange tube for receiving the heat exchange fluid from said heat exchange tube, said outlet tube having a first end extending completely through said supply conduit in a transverse direction and being coupled to a discharge conduit said outlet tube further having a second open end at said closed end of said heat exchange tube.

3. The heat exchanger of claim 2, wherein said outlet tube is positioned concentric with said heat exchange tube.

4. The heat exchanger of claim 3, wherein said open end of said outlet tube defines an opening facing a radial direction with respect to said heat exchange tube and said outlet tube.

5. The heat exchanger of claim 3, wherein said open end of said outlet tube defines an opening formed on an incline with respect to a longitudinal axis of said outlet tube.

6. The heat exchanger of claim 2, comprising a plurality of said heat exchange tubes having a respective outlet tube, each of said heat exchange tubes being coupled to said supply conduit, and each of said outlet tubes being coupled to said discharge conduit.

7. The heat exchanger of claim 2, further comprising a plurality of said supply conduits coupled to a primary supply conduit and a plurality of said discharge conduits coupled to a primary discharge conduit.

8. The heat exchanger of claim 7, wherein each of said heat exchange tubes are disposed in a vertical direction with said closed end facing an upward direction and said discharge conduit disposed at a downward end.

9. The heat exchanger of claim 2, wherein said heat exchange tube has a substantially cylindrical shape and includes an end plate fixed to and closing said second end.

10. The heat exchanger of claim 9, wherein said end plate is welded to said heat exchange tube.

11. The heat exchanger of claim 9, wherein said open end of said outlet tube is formed on an incline with respect to an axis of said outlet tube to define a tip of said outlet tube and an opening facing radially outward toward a side wall of said heat exchange tube.

12. The heat exchanger of claim 11, wherein said tip of said outlet tube contacts said end plate to stabilize said outlet tube within said heat exchange tube.

13. The heat exchange tube of claim 12, wherein said tip is fixed to said end plate.

* * * * *